United States Patent [19]

Vits

[11] 4,309,830

[45] Jan. 12, 1982

[54] APPARATUS FOR THREADING A FLOAT WEB DRYER

[75] Inventor: Hilmar Vits, Leichlingen, Fed. Rep. of Germany

[73] Assignee: Vits Maschinenbau GmbH, Langenfeld, Fed. Rep. of Germany

[21] Appl. No.: 131,403

[22] Filed: Mar. 18, 1980

[30] Foreign Application Priority Data

May 19, 1979 [DE] Fed. Rep. of Germany ..... 2920329

[51] Int. Cl.[3] ..... F26B 13/10; F26B 13/20

[52] U.S. Cl. ..... 34/120; 34/155; 34/156; 83/154; 226/92; 242/56 A

[58] Field of Search ..... 34/236, 56, 155, 156, 34/153, 158, 163, 117, 120; 83/150, 151, 154; 242/56 A, 56 R; 226/91, 92

[56] References Cited

U.S. PATENT DOCUMENTS

| | | | |
|---|---|---|---|
| 3,362,087 | 1/1968 | Brock | 34/158 |
| 3,508,342 | 4/1970 | Levtchouk et al. | 34/120 |
| 3,643,343 | 2/1972 | Marchal | 34/120 |
| 3,892,012 | 7/1975 | Keferstein | 242/56 A |
| 4,079,877 | 3/1978 | McAnespie et al. | 34/120 |
| 4,171,780 | 10/1979 | Bugnone | 242/56 A |

*Primary Examiner*—Larry I. Schwartz
*Attorney, Agent, or Firm*—Kenyon & Kenyon

[57] ABSTRACT

For threading a web through a float web dryer which pneumatically floats the web when traveling through the dryer, a transverse bar mounted by chains and having needles for engaging the web, picks up the start of the web and carries it through the dryer.

6 Claims, 6 Drawing Figures

APPARATUS FOR THREADING A FLOAT WEB DRYER

BACKGROUND OF THE INVENTION

A float web dryer conventionally comprises an enclosure having an entrance and exit and through which a traveling web to be dried is transported while supported or floated via upwardly ejected air jets which support the web free from mechanical contact while traveling through the dryer.

The enclosure may be formed by upper and lower chambers which can be opened from each other if this is required to thread the start of the web through the dryer. Threading may require not only opening of the two chambers, but a reduction in the air jet force, and usually the use of highly trained operators.

In the paper industry such a dryer can be provided with a threading device in the form of chains which can be used by the operators to engage one edge portion of the paper web so as to carry the start of the web through the dryer to a driven pulling drum about which the web is then wrapped to pull the web through the dryer.

In other fields the web may be composed of relatively loose fibers so that the web is unable to resist substantial tensioning or pulling forces when applied locally to the web. An example of such a web is one that is in the form of a matting of fibers such as fiberglass matting. In such cases the web can be torn apart by treatment which might be satisfactory when threading a float dryer with a paper web.

One solution is to provide the float dryer with a transport screen which carries at least the starting end of the fibrous web through the float dryer. However, loose fibrous material forming a matted web is usually impregnated with an adhesive treatment substance applied in a more or less liquid phase and which is why the web requires drying. Such a substance sticks to a transport screen and ultimately requires the screen to be cleaned in one way or another and involving substantial servicing expense.

The object of the present invention is to provide an apparatus for threading such a fibrous material web through a float dryer without requiring opening of the dryer's chambers, the use of expert operating personnel or expensive servicing of the apparatus.

SUMMARY OF THE INVENTION

According to the present invention the above object is achieved by providing the float dryer with two transversely interspaced chains or their equivalent which run through the dryer's entrance to and from its exit and as endless loops running back to the entrance. These chains carry at least one transverse bar provided with needles pointing at least at a slight angularity in the traveling direction of the chains, the bar being mounted transversely by and between the chains. The chains form a transport means for the bar. With this arrangement the chains travel throughout the length of the dryer from its entrance to its exit end. Therefore, by fixing the starting or front end of the web to the needles this end can be carried through the dryer for threading of the web through the dryer. The needles pick up the front end of the web which is easily penetrable because fibrous in nature, and carry the end of the web through the dryer to the pulling drum at the exit end of the dryer, and which continuously pulls the web thereafter through the dryer.

Fibrous material, such as fiberglass mat, usually leaves its production equipment with a starting or forward end which is narrower than the intended width of the normally produced web. Therefore, the present invention provides for a cutting blade carried by the chain-carried bar in front of the needles, and which severs the web after the web has been produced with its full intended or design width, the severed portion being discarded as scrap. The needles behind the blade pick up the thus squared-off end of the web and carry it through the dryer to the pulling drum which then continues to pull the web through the dryer with the air jets, possibly heated, supporting the web throughout its extent against sagging in the dryer.

At the exit end of the dryer the pulling drum delivers the dried web to a winding device which may be of the type having winding drums mounted by arms which rotate about a fixed axis so that when one winding drum winds to its design capacity the other drum can be rotated to a position receiving the next supply of web. With the chains carrying the bar with its needles and blade through the dryer, the chains are designed as endless chains which from the exit end of the dryer return to the dryer's entrance end, and this winding device must necessarily be located within the chain loops at the exit end of the dryer.

According to this invention, the winding device can be provided with wheels on which the chains loop about the outside of the winding device and return to the entrance end of the dryer.

The cut-off blade is preferably of the serrated type with its peak aligned with the needles which are in turn mutually aligned in rows in their direction of travel. To assure good needle penetration and cut-off action of the blade, a web counter roll is provided at the dryer's entrance end; and to provide clearance for the needles and the blade peaks, this counter roll is formed with grooves dimensioned and oriented for this purpose.

The needles function as a means on the transport bar for engaging the web when the web and bar are guided together with the needles penetrating the web at the dryer's entrance end, for continuously engaging the web during travel through the dryer, and releasing the web beyond the dryer's exit end by guiding the chains and web apart from each other so the web is pulled from the needles.

A specific example of the invention is illustrated by the accompanying drawings and described by the following description of those drawings.

DESCRIPTION OF THE DRAWINGS

The accompanying drawings are schematic and include various views as follows.

DETAILED DESCRIPTION OF THE DRAWINGS

Figure 1:
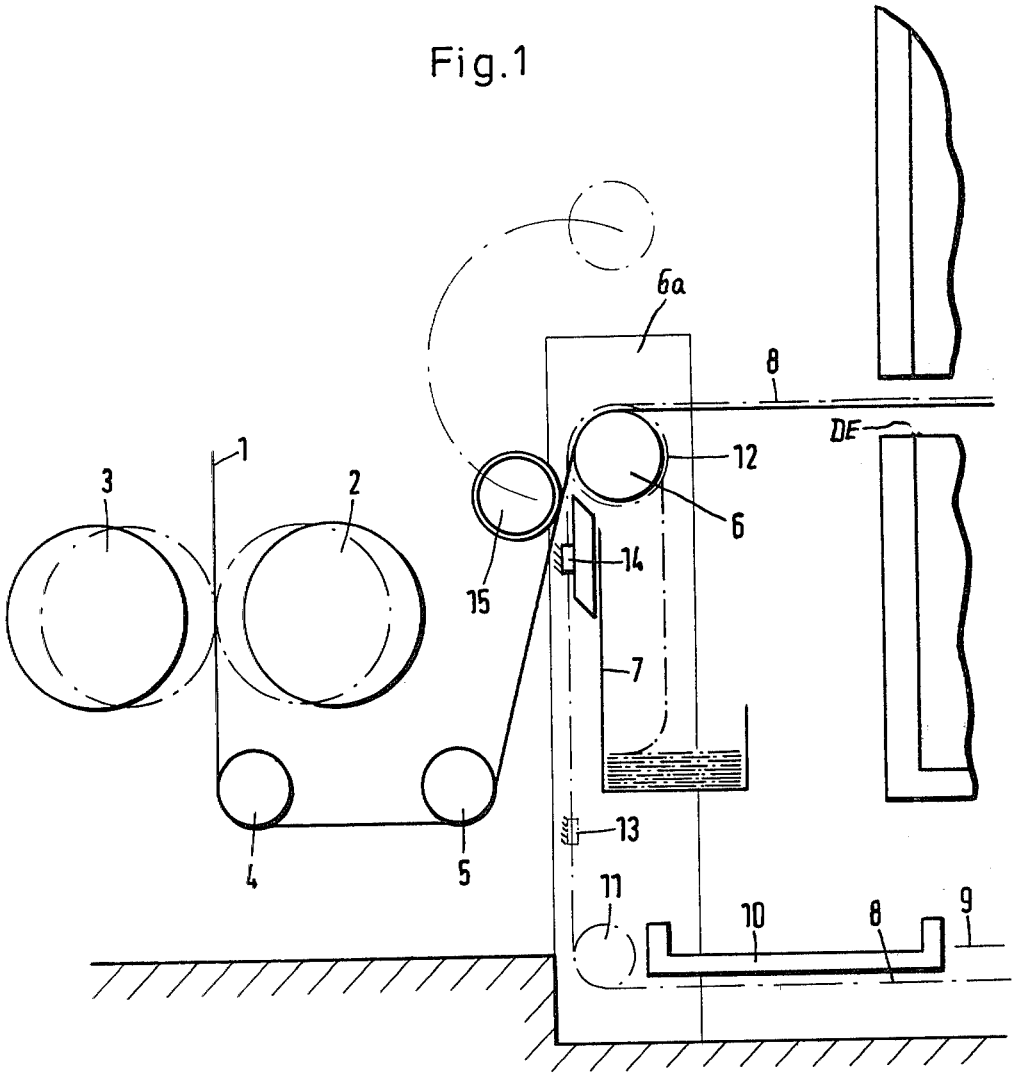
FIG. 1 is a vertical section showing the front or feeding end of the new threader at the entrance end of the dryer.

In the specific example of this invention illustrated by the above drawings, the web 1 can be made of an uncompacted and unwoven fibrous material, as might be exemplified by fiberglass matting. Its use requires impregnation with a material which can be considered as being glue-like or a wet adhesive, effected by the rolls 2 and 3. Assuming that the web 1 has left its manufacturing phase with an advancing or starting end having a width less than the design width of the web, this advancing end runs under the rollers 4 and 5 and upwardly over a power driven drum 6, this end having a width less than designed running downwardly into a collection pan 7. The rollers and drum 4, 5 and 6 can be out in the open and exposed so that the advancing end of the web can be easily fed around them manually without complications or skill, with the waste or narrow part running down into the collection pan 7.

Sprocket chains 8, which can be interspaced slightly more than the design width of the web, run to the left in FIG. 1 at the bottom below the base level 9 of the dryer and under a pan 10 which can collect possible drippings from the web, and around sprocket wheels 11 and upwardly over sprocket wheels 12 rotating free from the drum 6 but about its axis, and then forwardly through the dryer entrance marked DE in FIG. 1. The drum 6 is driven in a direction towards the dryer by a power unit, indicated at *6a*, and although not illustrated, the sprocket wheels 11 can be driven by and in synchronism with the drum 6 via a clutch which when disengaged permits the sprocket wheels 11 and chains to remain stationary while the drum 6 continues to be rotatively driven.

Figure 2:
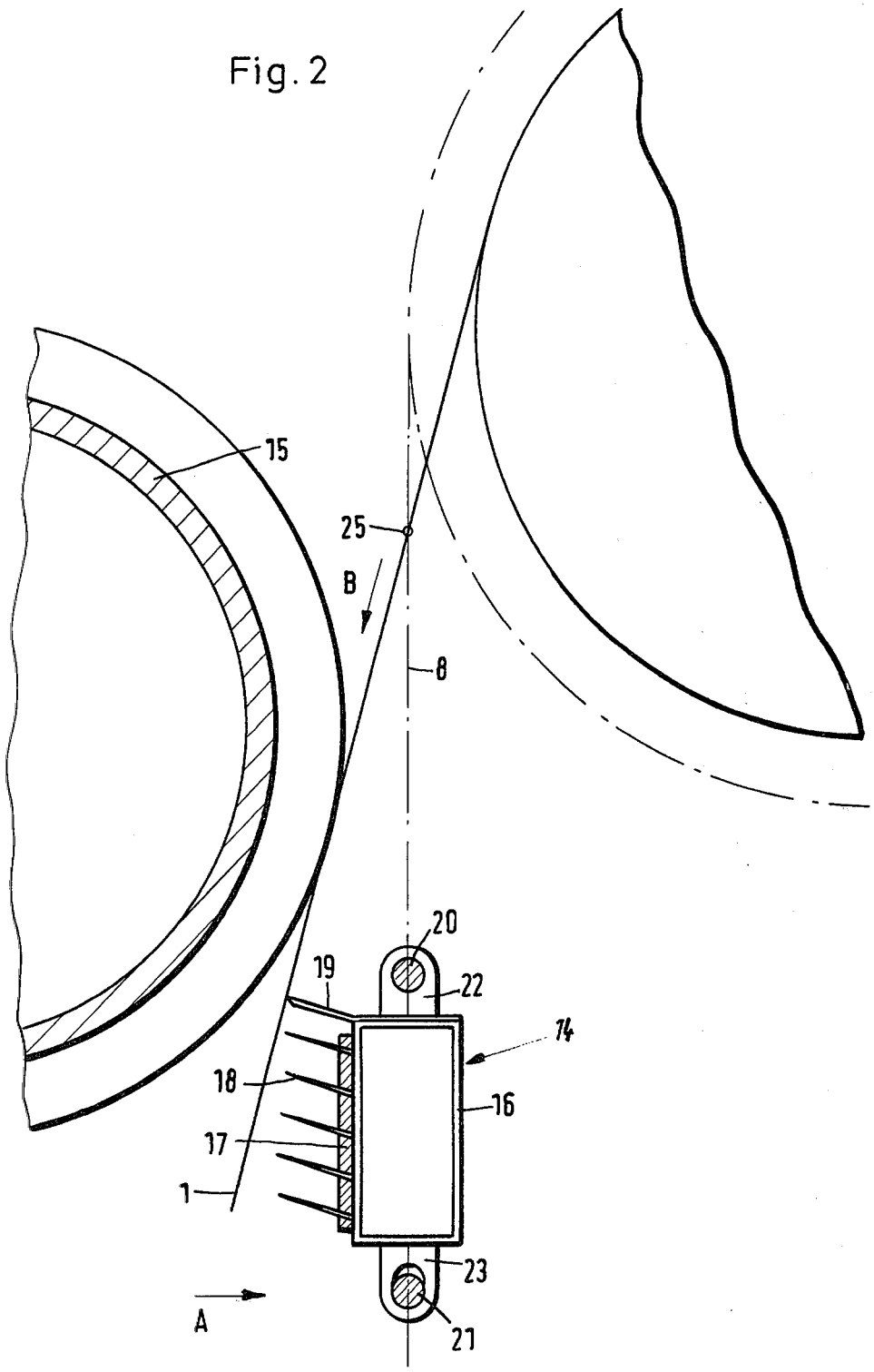
FIG. 2 is an enlarged scale view of the feeder details and is taken from FIG. 1.
Figure 3:
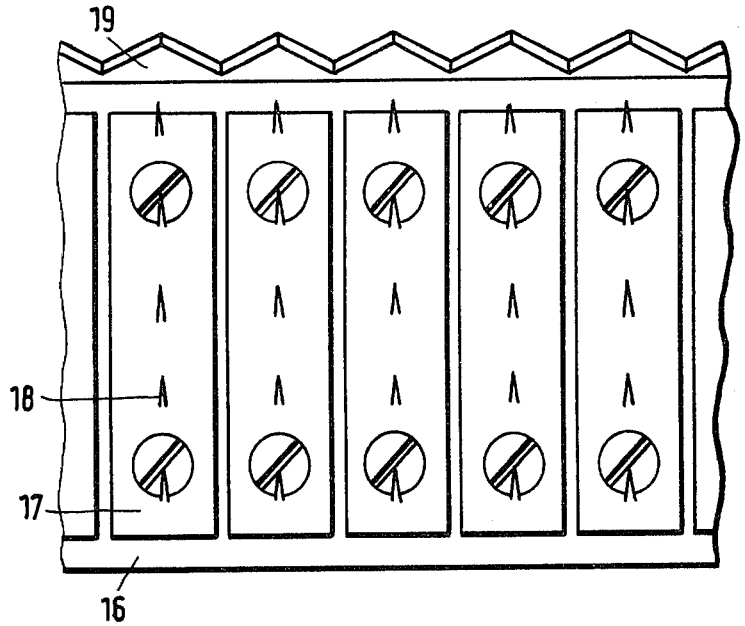
FIG. 3 is a front view of a further enlarged scale and showing the arrangement of the needles and cutter blade previously referred to briefly.

As shown in greater detail by FIGS. 2 and 3, the sprocket chains 8 carry the cross bar for the needles and cutter blades previously referred to, from the normal starting station 13 upwardly, as explained hereinafter. This bar is part of an assembly 14 which comprises the cross bar 16 of hollow box-shaped cross section and having on the web's side a mounting 17 fixed to the bar in a preferably releaseable manner and mounting the needles 18 and the cutter blade 19 which are all forwardly angled relative to the chain's traveling direction. The connection with the sprocket chains may be via cross rods 20 and 21 forming part of the chain link connections and connected with the bar 16 via brackets 22 and 23.

Figure 4:
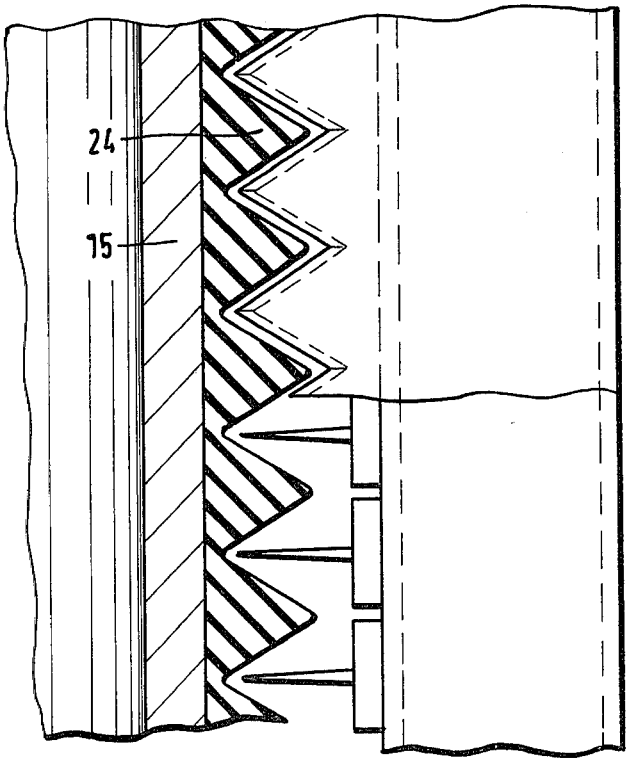
FIG. 4 on an enlarged scale in cross section shows how the counter roll is grooved to provide clearance for the serrated cutting blade and the needles.

When the bar 16, with its cutter blade and needles, is carried upwardly by the chains 8, it encounters the web 1 tangentially with respect to the web, this actuation being only after the web has reached its full intended width, the timing being normally under control of the operator. As the assembly 14 approaches the sprockets 12 and web tangentially, the web is provided with a counter pressure for the cutter blade and needles via a counter-pressure roll 15 having a periphery 24 formed by an elastically deformable material, such as rubber or synthetic rubber; and which as shown in FIG. 4, is provided with circumferential grooves providing clearance for the needles and the counter-bar serration peaks, keeping in mind that these are all aligned in the direction of travel of these parts.

In operation, assuming that the web 1 has a narrower than desired leading end, upward travel of the assembly 14, as viewed in FIG. 1, first cuts off the advancing narrow end of the web, which end has been feeding down into the pan 7. The needles 18 penetrate the soft fibrous web so as to engage the same throughout its entire width and carry this now squarely cut or right angular end over the drum 6 and into the entrance DE of the dryer through which the web is pneumatically supported by the usually upwardly directed pressurized air jets (not shown). The counter pressure drum 15 can be swung aside for manual initial threading of the web over the drum 6, as indicated in broken lines by FIG. 1, and in any event, this drum 15 is not used after threading is completed.

With the web's squared front end now carried safely and positively through the dryer, the web exits to the equipment illustrated by FIGS. 5 and 6, and described as follows:

At this exit end 25 of the dryer, the advancing end of the web 1 carried along by the chains 8 via the bar 16 and its needles, is pulled around the pulling drums 26, 27 and 28, one or more of which are rotatively powered, with the web then being pulled to and over one of the winding drums of a winder 29.

This winder has a base rotatively mounting, via a horizontal axis, arms 30 journaling web winding drums 31 and 32 which are rotatively powered as usual, and via right angular arms, undriven rotative drums 33 and 34 about which the web can travel is desired. This winder 29 can be designed so that when, as shown in FIG. 5, the drum 31 is positioned as shown, by looping around the winder as later explained, the chains and cross bar with its needles carry the mat over the drum 31 and possibly even the drum 33. At some time after the web is carried over the drum 31, a severing and tacking device 36 severs the web end and tacks it onto that one of the rotatively driven winding drums. This device can be operated by a hydraulic or pneumatic actuator 37 which swings levers 38 between operative and inoperative positions. In their operative position a pressure cylinder 39 can tack the advancing mat to the drum 31, the device including a rotative cutter 40 which then severs the preceding part of the web from the part tacked to the drum 31, the cutter 40 being carried by a pivotal arm 41 actuated at the appropriate time by a fluid pressure cylinder actuator 42. The cut advancing end of the web may be of substantial length, as is indicated by FIG. 5, but in any event, it is carried by the needles and cutter bar via the chains back to the starting location 13 shown in FIG. 1, where it can be removed. The length of the advancing end of the mat which is cut off is operational.

It is necessary to loop the chains around this winder 29 to get the chains back to the entrance end of the dryer. For this purpose the shafts of the drums 31 to 34 journal freely rotatable sprocket wheels 46 through 49 respectively and about which the chains 8 loop around the winder for their return journey. It is to be understood that the arm 30 and the drums it carries are rotative, so that when one drum, such as 31, becomes filled, it can be replaced by, for example, the drum 32 to receive the next winding of web. The relative orientation and interspacing of the sprocket wheels 46 through 49 can be such that as the coiler assembly rotates, the effective lengths of the chains 8 do not change substantially, with the understanding that these chains may include the usual chain-length adjusting links, considering the possible length changes due to thermal expansion and contraction of the chains.

The provision of normal automatic controls are not described, but with the understanding that whether this invention is automated or manually controlled, its complete operation is substantially as follows:

Assuming the dryer is empty or unthreaded and an oncoming web with its narrow leading end is advancing from the web production equipment, the web is manually fed between the impregnating or coating rolls 2 and 3, under the rolls 4 and 5 and to and over the driven drum 6. The pressure roller or drum 15 can be swung aside as indicated by broken lines in FIG. 1. With the traveling web end over the drum 6, which is power driven, the narrow or waste end of the web feeds down into the pan 7. When the full width of web arrives, the counter-pressure roller 15 is positioned as shown in FIG. 1. The chain driving sprocket wheels 11 can then be driven via a conventional connection with the drum 6 if an interposed clutch is provided; and if this design is used, the clutch is engaged so that the chains, with their cross bar and its needles and cutting bar assembly 14 at the starting station 13 now advance as indicated by FIG. 1. The cutting blade 19 squarely severs the now full width web while the needles 18 penetrate the web and carry the square-cut end of the web up over the drum 6 and through the dryer in a positive manner without manual expertise or opening of the dryer enclosure. Full air jet pressure can be used to fully support the feeding web in the dryer. No localized stress is applied to the web.

Figure 5:
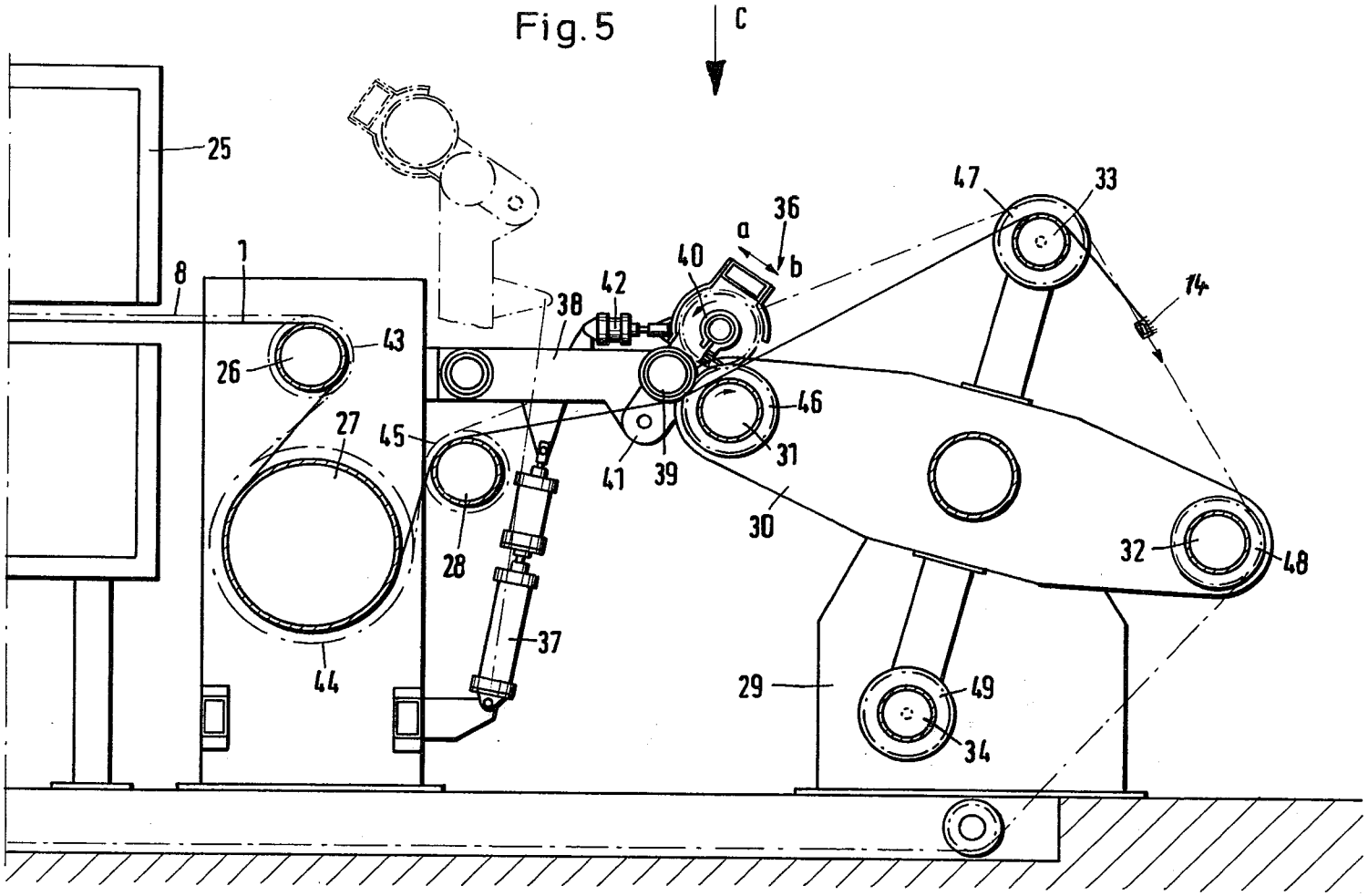
FIG. 5 in vertical section shows how at the exit end of the dryer the necessary mat-winding device permits the chains to reversely loop back to the dryer's entrance end.
Figure 6:
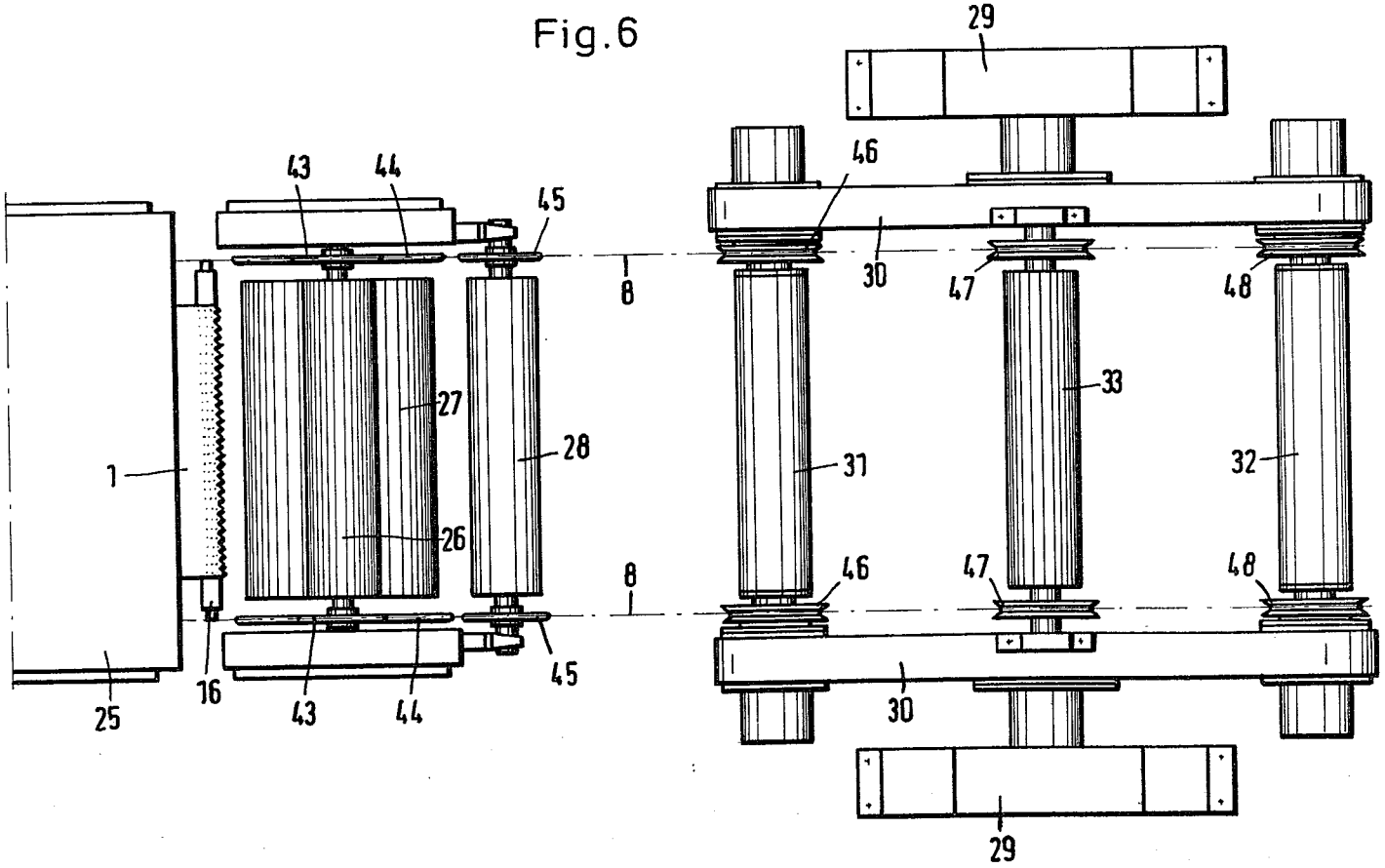
FIG. 6 is a plan view of FIG. 5 looking down in the direction indicated by the arrow C in FIG. 5.

At the exit end 25 of the dryer, referring now to FIG. 5, the web is pulled by and around the powered pulling drums 26 and 27 and 28. The chains and assembly 14 then carry the web upwardly towards the drum 33 in the case of the FIG. 5 illustration. Actuation of the cutting device 36 cuts the leading end while tacking its cut end, in this case, to the winding drum 31. The web need not be carried as far beyond the drum 31 as is illustrated by FIG. 5, but the length remaining after the cut-off by the device 36 is, of course, carried along and reversely back to the station 13, shown by FIG. 1, where the cut-off length can be removed. The power for driving the chain is derived from the sprocket wheels 11, the sprocket wheels shown at 43, 44, 45 and 46 through 49 being freely rotative sprocket wheels for guiding the chains which loop around the winder 29 for return of the chains to the entrance end of the dryer.

The motion of the device 36 pushes the web from the needles of the assembly 14 with the roller 39 pressing the web against one or another of the winding drums 31 and 32 for the winding operation. The bar 16 with its needles and cutter bar must extend, of course, for the full width of the web being threaded through the dryer.

What is claimed is:

1. An apparatus for threading a web through a float web dryer having a web entrance and exit, the apparatus comprising a bar extending for the entire width of the web to be threaded and having ends projecting beyond the web's side edges, transport means for transporting the bar via both its ends transversely with respect to the web forwardly from a starting position outside of said entrance and through the dryer and to a position outside of said exit, said bar having web-engaging means for engaging the web substantially throughout its entire width when the web and bar are moved together tangentially relative to each other and releasing the web when the web and bar are moved apart from each other, and means for guiding said bar and web together tangentially at said starting position and apart at a position outside of said exit.

2. The apparatus of claim 1 in which said bar has cutting means in front of said web-engaging means for transversely cutting the web when the web and bar are initially guided together.

3. The apparatus of claim 1 in which said web-engaging means comprises a plurality of forwardly angled needles which engage the web by penetrating the web and release the web by pulling free from the web.

4. The apparatus of claim 3 in which said cutting means comprises a forwardly angled knife blade mounted by said bar transversely with respect to the web and in front of said needles.

5. The apparatus of claim 4 in which said knife blade has serrations and said needles are in rows extending in the transport direction of the bar and aligned with the peaks of said serrations, and a counter-pressure roll is positioned so as to hold the web against the action of the knife blade and needles and is circumferentially grooved so as to provide clearance for passage of the knife blade's serrations and said needles.

6. The apparatus of claim 1 in which said transport means comprises laterally interspaced endless chains to which the ends of said bar are connected, said chains forming endless loops traveling through said dryer and beyond its exit end looping downwardly so the chains travel under the dryer back to said starting position, a web winder being positioned at the dryer's said exit end, and guiding means being provided for guiding said chains so they loop around said web winder.

* * * * *